United States Patent [19]

Hazard

[11] Patent Number: 4,981,131

[45] Date of Patent: Jan. 1, 1991

[54] PASSIVE MOTION BACK SUPPORT

[76] Inventor: Rowland G. Hazard, 177 S. Prospect St., Burlington, Vt. 05401

[21] Appl. No.: 393,829

[22] Filed: Aug. 14, 1989

Related U.S. Application Data

[63] Continuation of Ser. No. 167,373, Mar. 14, 1988, abandoned.

[51] Int. Cl.[5] ..... A61H 1/00; A61H 9/00

[52] U.S. Cl. ..... 128/38; 128/25 R; 128/33; 128/69; 128/118.1; 297/DIG. 3; 297/284

[58] Field of Search ..... 128/69, 70, 118.1, 95.1, 128/96.1, DIG. 20, 38, 845, 870, 25 R, 30, 30.2, 39, 33; 297/284, DIG. 3, 460

[56] References Cited

U.S. PATENT DOCUMENTS

| | | | |
|---|---|---|---|
| 1,147,560 | 7/1915 | Shurtleff | 128/DIG. 20 |
| 2,528,843 | 11/1950 | Poor | 128/DIG. 20 |
| 2,531,074 | 11/1950 | Miller | 128/DIG. 20 |
| 2,819,712 | 1/1958 | Morrison | 297/DIG. 3 |
| 3,148,391 | 9/1964 | Whitney | 297/DIG. 3 |
| 3,196,868 | 7/1965 | Johnston | 297/284 |
| 3,326,601 | 6/1967 | Vanderbilt et al. | 297/DIG. 3 |
| 3,477,071 | 11/1969 | Emerson | 297/284 |
| 3,760,801 | 9/1973 | Borgeas | 128/25 R |
| 3,770,315 | 11/1973 | Smittle et al. | 297/DIG. 3 |
| 4,178,923 | 12/1979 | Curlee | 128/DIG. 20 |
| 4,524,762 | 6/1985 | Schulman | 297/284 |
| 4,634,179 | 1/1987 | Hashimoto et al. | 297/DIG. 3 |
| 4,675,297 | 11/1979 | Robbins et al. | 297/DIG. 3 |
| 4,703,750 | 11/1987 | Sebastian et al. | 128/DIG. 20 |
| 4,707,027 | 11/1987 | Horvath et al. | 297/DIG. 3 |

FOREIGN PATENT DOCUMENTS

| | | | |
|---|---|---|---|
| 7806327 | 12/1979 | Netherlands | 128/78 |

*Primary Examiner*—Robert A. Hafer
*Assistant Examiner*—Kevin G. Rooney
*Attorney, Agent, or Firm*—Choate, Hall & Stewart

[57] ABSTRACT

A method for providing cyclic mobilization of the lumbar spine of a person includes providing a fluid-inflatable bag, positioning the bag behind and adjacent the lumbar region of the person, and alternately directing fluid to flow into and out of the bag to inflate and to deflate the bag to vary forces applied to the spine of the person thereby moving the spine through a range of degrees of lordosis. Also, apparatus for providing support and spinal movement to the lower back of a person includes a fluid-inflatable bag adapted to be positioned behind and adjacent the lumbar region of the person, a source of fluid under pressure, a conduit adapted to conduct the fluid between the source and the bag, and a regulator adapted for controlling the flow of the fluid in the conduit; the flow of fluid alternately causes inflation and deflation of the bag, and the inflation and deflation of the bag applies greater and lesser forces to move the spine of the person through a range of degrees of lordosis.

18 Claims, 4 Drawing Sheets

PASSIVE MOTION BACK SUPPORT

This is a continuation of co-pending application Ser. No. 167,373 filed on Mar. 14, 1988 now abandoned.

BACKGROUND OF THE INVENTION

This invention relates to inflatable apparatus for providing support and movement to the lower back.

In the human lower back or lumbar region some degree of lordosis, that is, of forward spinal curvature, is normal. The degree of lordosis varies within the human population, and changes in each person as the back is bent forward (reducing lordosis) or backward (enhancing lordosis). In particular, lordosis is generally less in a person when sitting than when standing, and varies more as a person moves about than when a person is sedentary.

Back pain, and particularly lower back pain, is a widespread and often debilitating malady, occurring intermittently or chronically and ranging in severity from distracting discomfort to agony. Lower back pain may be caused by a disease such as osteoarthritis, an infection, or a tumor; or by a congenital bony defect; or by trauma or injury such as a ruptured intervertebral disk; or by back strain owing to overweight or strenuous work; or even, apparently, by sitting for extended periods. Often the precise cause of lower back pain cannot be satisfactorily determined.

Medical evidence suggests that back pain stems from a complex interplay of personal factors, including the person's age and occupation and the extent to which the person is seated unmoving over the course of the day. Complaints of back pain are increasing among workers having sedentary occupations, and it is well known among occupational health professionals that prolonged static seating places an individual at risk for both acute and cronic back pain associated with muscular, ligamentous, and intervertebral disc problems related to the mechanical stresses of sitting.

Various therapies for lower back pain have been advanced, and these have met with varying degrees of success. Manipulation of the bony elements of the spine by a trained professional therapist is an approach that can provide relief for some kinds of back pain; but often the relief is transitory, and in these cases such an approach can require frequent and repeated visits to the therapist. And, for example, R. McKenzie, 1981, *The Lumbar Spine,* Spinal Publications Limited, New Zealand, described exercises designed to relieve pain through occasional lumbar movement. The various approaches have not proven adequate to overcome the widespread and persistent problem of back pain associated with sitting.

S. Reinecke et al., 1985, Proc. Am. Soc. Biomechanics, Ann Arbor, Mich., and S. Reinecke et al., 1987, Rehabilitation Engineering Society of North America, 10th Annual Conference, San Jose, Calif., determined tolerance times for static sitting by subjecting persons to static sitting in various positions. Subjects complained of low back pain and indicated that they believed their tolerance times would increase if they were able to move periodically. T. Bendix, 1987, Adjustment of the Seated Work Place, Ph.D. Dissertation, Laegeforeningens Forlag, investigated the effect of movement on seating comfort and postulated that the amount of movement or changes in posture of a seated person can provide a measure of the person's discomfort.

S. Holm et al., 1983, Spine, vol. 8(8), pp. 866–874, studied the effects of various spinal movements on the intervertebral discs of dogs, and concluded that continuous moderate spinal movement for half an hour each day sufficed for maintaining effective nutrition transport to and from disc tissues and for stimulating aerobic metabolism within the most mobile intervertebral discs, of the canine spine. E. Grandjean, 1981, *Fitting the Task to the Man,* Taylor and Francis, London, suggested that movements that alternately load and unload the spine pump fluid into and out from the discs, improving the nutritional supply to the tissues.

It is known to produce a superficial soft tissue massage effect by means of a plurality of inflatable tubes placed between a person and a seat or mattress. For example, N. Hashimoto et al., U.S. Pat. No. 4,634,179 describes an air lumbar support device for a car seat in which the curvature of the seat back is adjusted by selectively regulating the pressures of a plurality of air bags accommodated in the seat back, including pressure sensors and control means for automatic adjustment to preset pressures. Hashimoto et al. noted that "it may be possible to attain the massage effect of the back and lumbar portions for recovering the fatigue of the driver by means of automatically oscillating the air bag pressures in several kinds of patterns."

T. Kashiwamura et al., U.S. Pat. No. 4,655,505 describes a vehicle seat having embedded in it a plurality of bags to which air is delivered by a compressor through a system of valves. Control means maintain pressure in the bags at preset valves. The pressure may be varied periodically in "a specific air bag for preventing the driver from dozing off." It is also possible "to periodically change the air pressure of all the air bags to the desire of the driver . . . by using a relatively short period or high frequency it is possible to effectively reduce the fatigue of the driver by applying a massage to him."

Alternating pressure pads, sometimes termed "ripple" pads, have interdigitating sets of tubes or cells that are alternately or serially inflated and deflated so that the person is supported by pressure at different areas of -the body at different times, to produce a superficial soft tissue massage effect. Some of these include a timed cycle of inflation together with pressure control or pressure regulation, as described for example in A. E. Corbett et al., U.S. Pat. No. 4,255,989, R. J. P. Evans, U.S. Pat. No. 3,678,520, J. A. Green, U.S. Pat. No. 4,132,228, W. C. Morrell, U.S. Pat. No. 3,867,732, and R. J. D. Welch, U.S. Pat. No. 4,193,149.

SUMMARY OF THE INVENTION

In general, the invention features, in one aspect, apparatus for providing support and spinal movement to the lower back of a person including a fluid-inflatable bag, a source of fluid under pressure, a conduit adapted to conduct the fluid between the source and the bag, and a regulator adapted for controlling the flow of the fluid in the conduit and the pressure in the bag. The flow of fluid alternately causes inflation and deflation of the bag in cyclic fashion, and the bag is adapted to be positioned behind and adjacent the lumbar region of the person, so that the inflation and deflation of the bag applies greater and lesser forces to cause cyclic mobilization of the spine of the person through a range of degrees of lordosis.

The term fluid, as used herein, includes any gaseous or gas mixture, such as, for example, air, and includes any liquid, such as, for example, water. Inflation includes an increase in volume of fluid contained within the fluid inflatable bag, accompanied by either change in shape of the bag or by stretching the bag, or by both change in shape and stretching.

In preferred embodiments the fluid is air and the source of said fluid under pressure includes an air pump; the apparatus further includes an adjustable valve for controlling the pressure of the fluid in the bag at maximum inflation; controlling the flow of fluid includes controlling the duration of the flow of the fluid directions causing inflation and deflation of the bag; and the regulator includes a timer for controlling the durations of inflation or deflation of the bag; and the timer is adjustable so that the durations can be selected independently of one another.

In another aspect, the invention features a method for providing cyclic mobilization of the lumbar spine of a person, including providing a fluid-inflatable bag, positioning the bag behind and adjacent the lumbar region of the person, and alternately directing fluid to flow into and out of the bag to inflate and to deflate the bag to vary forces applied to the spine of the person thereby moving the spine through a range of degrees of lordosis.

In preferred embodiments, the flow of fluid into the bag occurs during an inflation interval and the flow of fluid out of the bag occurs during a deflation interval, and the method includes independently controlling the duration of the inflation interval and the duration of the deflation interval; the method includes limiting the pressure of the fluid in the bag; and the method includes independently limiting the rate of flow of fluid into and out of the bag.

The back support and method of the invention provide cyclic passive mobilization of the lumbar spine of a person while seated or supine by cyclically imposing a selected amount of force to the lumbar region from behind the person. As used herein, the term mobilization includes movement of a skeletal joint, and the terms lordotic movement and-spinal mobilization mean a movement of the spine that includes flexing between adjacent vertebrae sufficient to alter the intervertebral discs. Increasing the amount of force provides a greater degree of lordotic movement, and by appropriately adjusting the pressure to match the individual person's lumbar compliance, that is the ease with which the individual's spine is mobilized when force is applied, the desired degree of lordotic movement can be obtained.

Effective, safe and comfortable lumbar mobilization, of a magnitude and at time intervals and speeds that are appropriate for the lumbar compliance of the particular individual, is provided according to the invention by adjustable timed cyclic control of flow of fluid to and from the fluid inflatable bag, and control thereby of the maximum pressure of fluid in the bag at the peak of the inflation cycle.

The back support can be used in conjunction with a chair or seat, so that a person who sits for extended times, as while working at a desk or a table or while riding in or operating a vehicle, can benefit from the cyclic spinal mobilization over the course of a day. Thus the person can realize some therapeutic benefits of spinal manipulation without the inconvenience of visits to a professional, and potentially with more enduring benefit.

Moreover, the back support can help in preventing some back pain in persons who spend a substantial part of the day in a sedentary occupation, by providing cyclic movement of the lumbar spine through greater and lesser degrees of lordosis. Since lumbar compliance varies from one person to the next, provision of safe and comfortable lumbar movement of adequate magnitude requires force and timing controls as described herein to suit the individual.

The back support can also be used when the person is in a supine position, as when resting or during times when the person is confined to bed.

The apparatus is easy to operate, as it runs automatically once the desired settings are made and the fluid pump and the control unit are switched on. On the basis of an examination, a specialist can recommend appropriate settings and a therapeutic regimen for each patient, and the patient can then use the apparatus in the home, workplace, or automobile, or wherever the patient sits for extended times in the course of the day. Alternatively, an individual can simply adjust the force and timing controls to provide a personal optimum of lumbar movement and comfort.

DESCRIPTION OF THE PREFERRED EMBODIMENTS

Drawings

Figure 2:
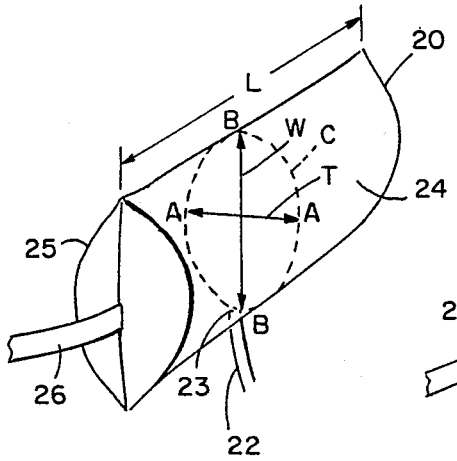
FIG. 2 is a perspective view showing an air bag of the apparatus of FIG. 1 fully inflated.
Figure 2A:
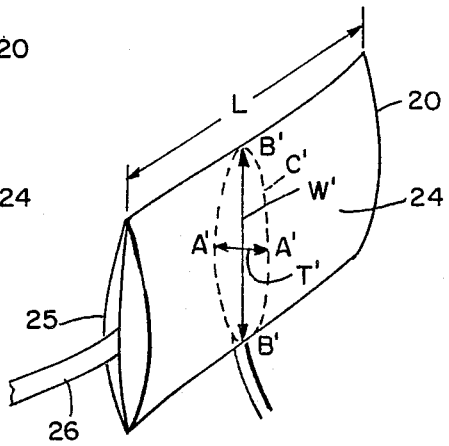

FIG. 2*a* is a perspective view showing the air bag of FIG. 2 collapsed.

Figure 1:
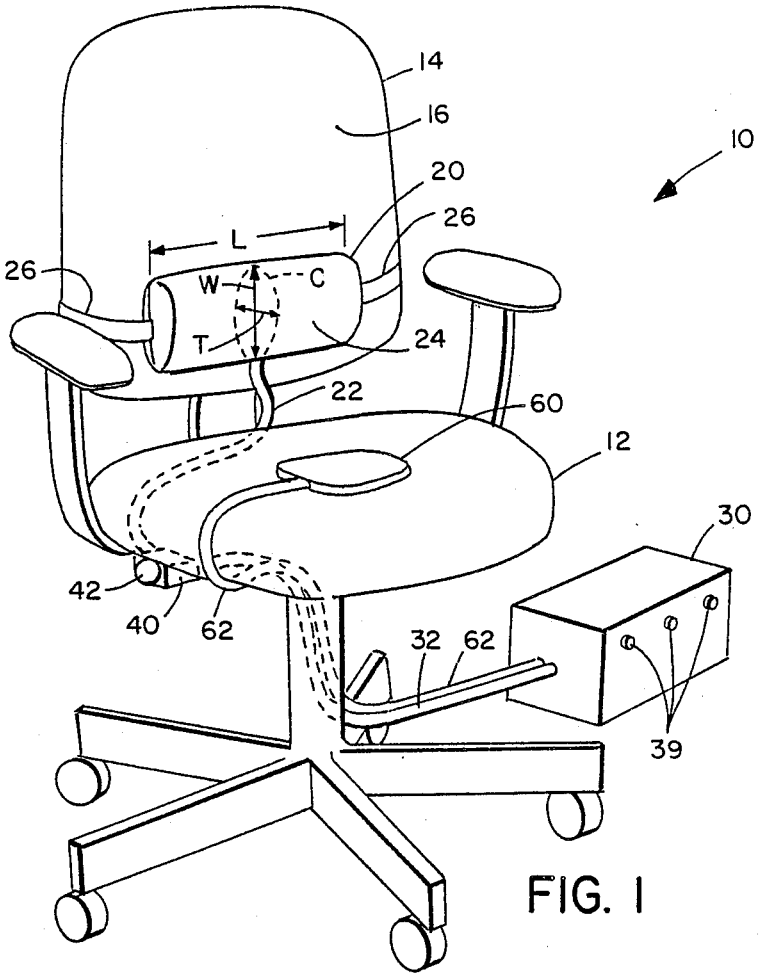
FIG. 1 is a perspective view of a continuous passive motion back support apparatus of the invention as arranged for use in conjunction with a chair.
Figure 3A:
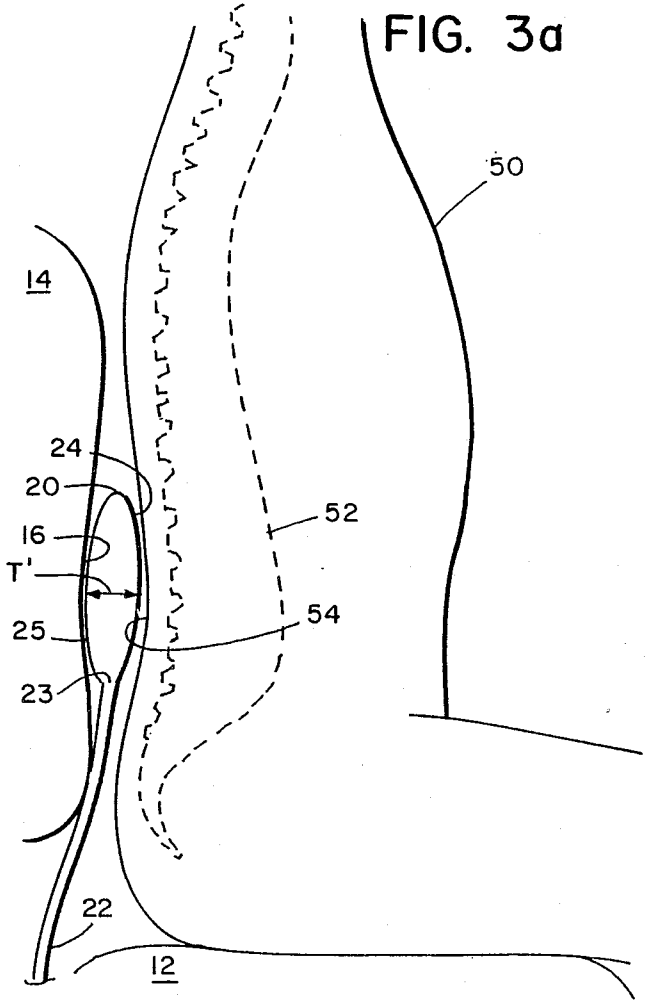
Figure 3:
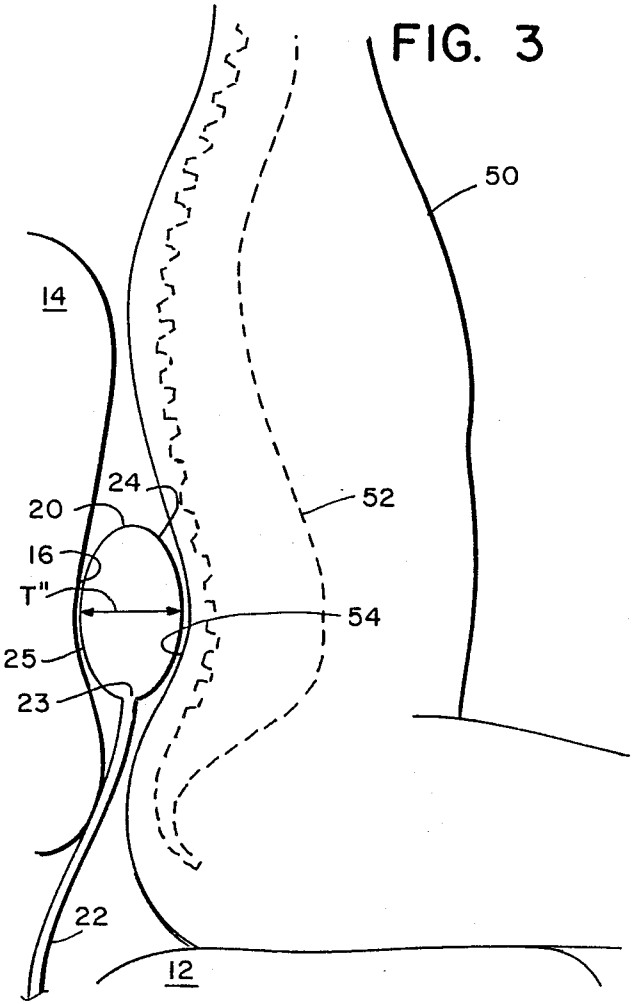

FIG. 3 is a diagram in side view showing a person seated in a chair provided with the back support apparatus of FIG. 1, where the air bag is fully inflated as in FIG. 2.

FIG. 3*a* is a diagram as in FIG. 3, where the air bag is deflated as in FIG. 2*a*.

Figure 4:
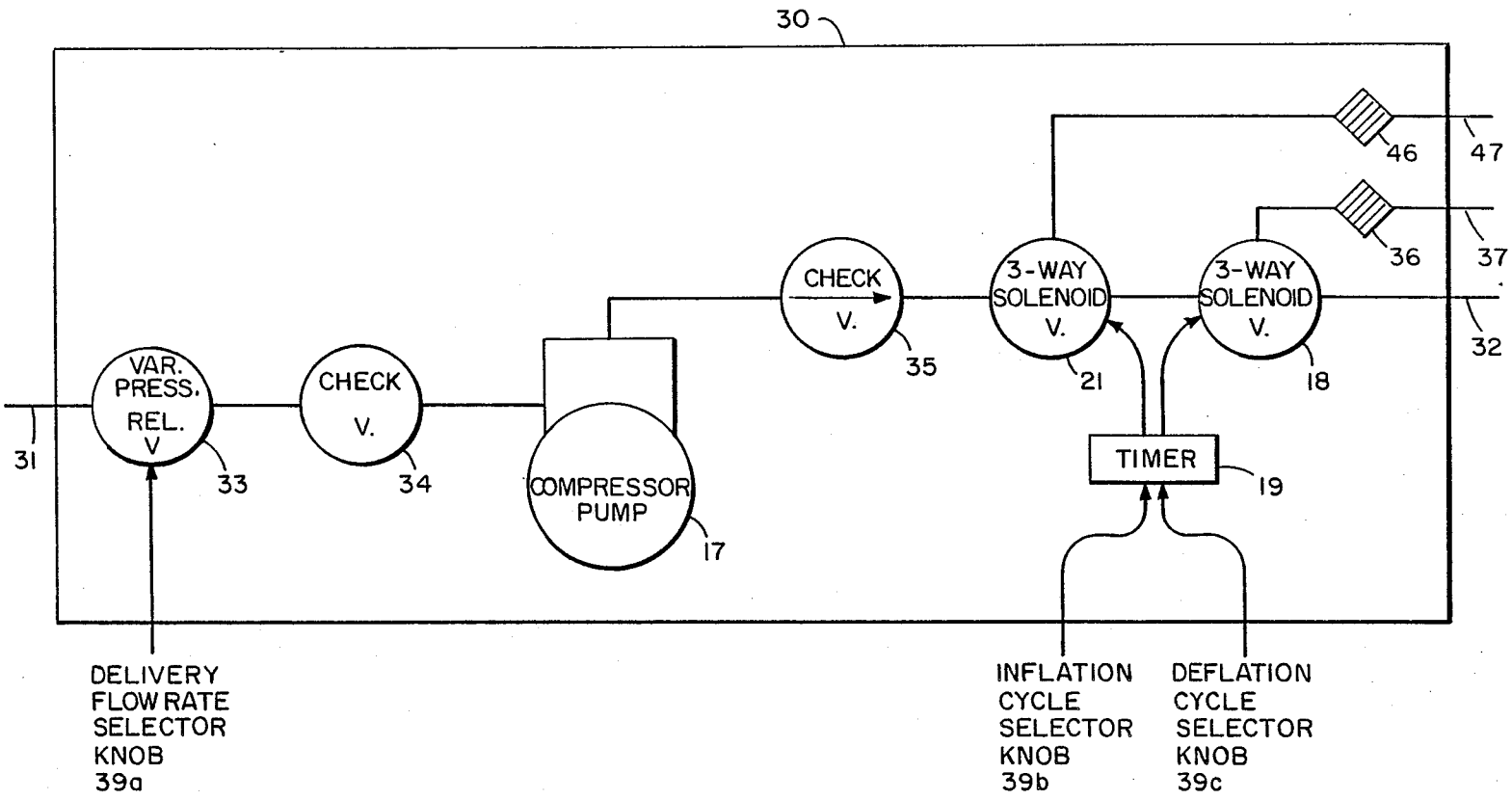

FIG. 4 is a diagram of apparatus for cyclically providing a supply of air under pressure for the back support of FIG. 1.

Figure 4A:
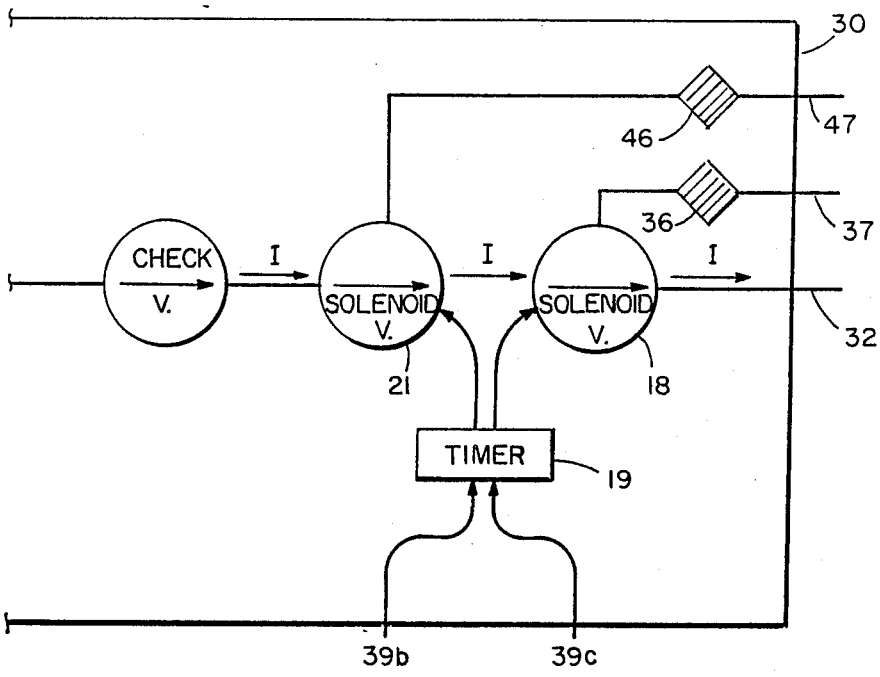

FIG. 4*a* is a part of the diagram of FIG. 4, showing the direction of flow of air during an inflation interval.

Figure 4B:
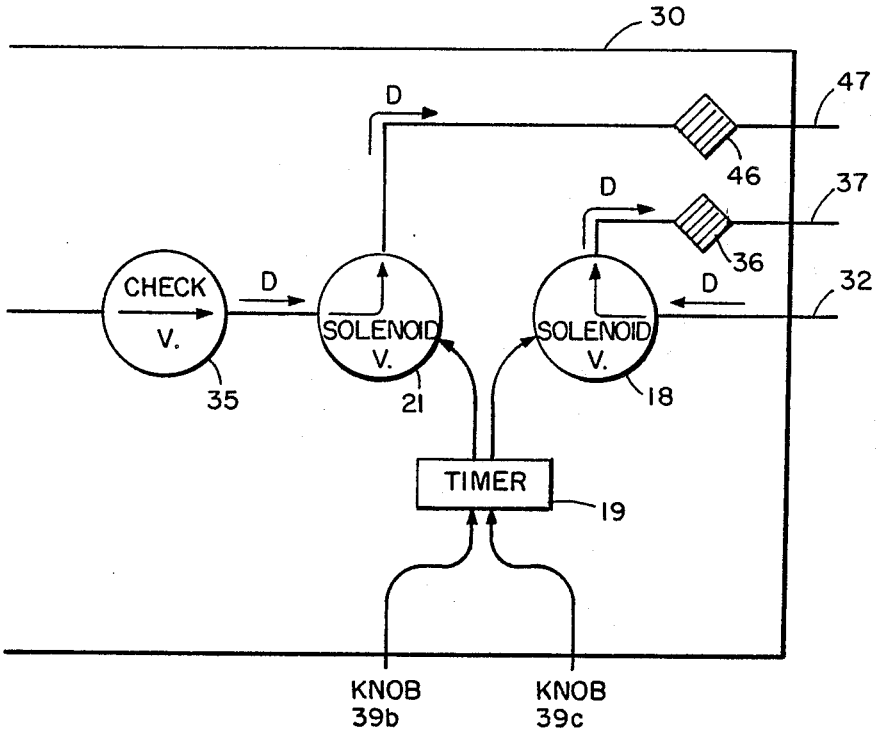

FIG. 4*b* is a part of the diagram of FIG. 4, showing the direction of flow of air during a deflation interval.

Structure

With reference now to FIG. 1, apparatus for providing cyclic passive motion back support is shown generally at 10 installed in conjunction with a standard office chair that includes seat 12 and back 14. The back support apparatus includes air bag 20, which is affixed to chair back 14; air supply and exhaust 30; variable pressure release valve 40; and tubes 32 and 22, which conduct air between, respectively, air supply 30 and valve 40, and valve 40 and air bag 20.

Air bag 20 is pliable and substantially air tight, so that it inflates when air is delivered into it, and it can be collapsed when air is permitted to flow out of it. Air bag 20 is preferably constructed of a flexible plastic sheet material such as a flexible vinyl polymer according to methods well known in the polymer art. Preferably the bag material does not stretch substantially under tensions created when the bag is at maximum inflation.

Variable pressure release valve 40 is of the precision pressure regulator type, well known in the pneumatics art, and includes adjustment knob 42 by which the user can adjust the maximum delivery pressure at which air passes from valve 40 through conduit 22 into air bag 20.

Air supply 30, described more fully below with reference to FIG. 4, includes an electrically-powered air pump for providing a flow of air under pressure; timer-controlled solenoid-actuated valves for alternately directing the air under pressure to flow to air bag 20 to provide inflation of the bag during an inflation interval and permitting air to flow from air bag 20 to provide deflation of the bag during a deflation interval, as described in detail below with reference to FIGS. 4, 4*a*, and 4*b*; and adjustment knobs 39 by which the user can adjust the durations of the intervals and the delivery flow rate from the air supply during inflation.

Air supply 30 and variable pressure release valve 40 together provide for inflation and deflation of air bag 20 in timed cyclic intervals and for control of maximum air pressure within air bag 20 during the inflation interval.

As shown diagramatically in FIG. 2, air bag 20 when fully inflated has a generally cylindroid shape with a length L and a substantially elliptical cross section midway its length, indicated by broken line C. Air bag 20 thus has a width W, equal to the longer dimension B—B of C, and a thickness T, equal to the shorter dimension A—A of C. The length L preferably is great enough to provide support across the full width of the user's back in the lumbar region.

During inflation in an inflation interval air conducted from air supply 30 via conduit 32 and variable pressure release valve 40 (not shown in FIGS. 2, 2*a*) passes, at a desired delivery rate and delivery pressure, through conduit 22 (shown in part in FIGS. 2, 2*a*) into air bag 20 via port 23.

Air bag 20 has no openings other than port 23, and air bag 20 expands as air is delivered into it until the inflation interval is complete or the maximum pressure limit at valve 40, shown in FIG. 1, is reached. When the time for the inflation interval has elapsed, the valves in air supply 30 are switched in response to a signal from the timer to permit air to flow out from air bag 20 via port 23 and conduit 22. Air bag 20 can collapse until it is fully deflated or until the time for the deflation interval has elapsed.

Air bag 20 is diagrammatically shown partially deflated in FIG. 2*a*, where it can be seen that air bag 20 has flattened. Because the plastic material of the bag does not stretch substantially during the inflation cycle, air bag 20 is wider ($W' > W$) and thinner ($T' < T$) when collapsed, as shown in FIG. 2*a*, than when it is fully inflated, as shown in FIG. 2; that is, its cross section midway its length, indicated by broken line C', has a longer dimension B'—B' and a shorter dimension A'—A' when it is inflated.

With reference now to FIGS. 4, 4*a*, and 4*b*, components of air supply 30 are shown diagrammatically in operational relation. Atmospheric air is drawn by air pump 17 into air supply 30 via intake port 31, through variable pressure release valve 33, which controls intake flow rate and limits delivery flow rate, and check valve 34. Air is delivered under pressure from the air pump through check valve 35 to solenoid valve 21. Solenoid valve 21, under control of timer 19, either (during an inflation interval) directs the air (as shown generally by arrows I in FIG. 4*a*) from pump 17 to solenoid valve 18, or (during a deflation interval) directs the air delivered by air pump 17 (as shown generally by arrows D in FIG. 4*b*) through muffler 46 and to the atmosphere via exhaust 47. Solenoid valve 18, also under control of timer 19, either (during an inflation interval) directs the air (FIG. 4*a*, arrows I) through conduit 32, valve 40 and conduit 22 to air bag 20 as described generally above with reference to FIG. 1, or (during a deflation interval) directs air returning from air bag 20 through conduit 22, valve 32 (as described generally above with reference to FIG. 1) and conduit 32 (FIG. 4*b*, arrows D) through exhaust muffler 36 to the atmosphere via exhaust 37.

Solenoid valves 18, 21 are preferably of the 3-way solenoid normally open type. Timer 19, coupled electrically with the solenoid which operates the valve in solenoid valves 18, 21, preferably can be adjusted by the user by means of interval selector knobs to determine the durations of the inflation interval and the deflation interval individually and independently. Variable pressure release valve 33 is preferably of the precision pressure regulator type, in which output flow is virtually unaffected by changes in supply pressure. Variable pressure release valve 33 can be adjusted by the user by means of an intake selector to regulate the rate of flow into the air supply. Check valve 34 permits flow of air only into the air pump from the atmosphere and check valve 35 permits flow of air only out of the compressor to solenoid valves 18, 21. Mufflers 36, 46 muffle the sound of air escaping through exhausts 37, 47, so that the apparatus is quiet during operation.

In the embodiment shown in FIGS. 1 through 4*b*, pump 17, drawing air from the atmosphere, provides a source of air under pressure; valve 40, valve 33, timer 19, and the timer-operated valves 18, 21 provide a regulator for controlling the flow of gas in the conduits and for controlling the pressure in bag 20 at maximum inflation.

Preferably the apparatus is provided with a pressure sensing device for automatically switching the air supply off when no one is sitting in the chair, and switching it on when the user sits in the chair. Such pressure sensing switch devices are well known. With reference again to FIG. 1, an inflatable bladder 60 is placed upon chair seat 12, connected by conduit 62 to a pressure sensitive switch (not shown) located in air supply 30. When the pressure on bladder 60, and thus in conduit 62, is below a predetermined threshold, the pressure sensitive switch is off, shutting off air supply 30; and when the pressure on bladder 60, and thus is conduit 62, is above the threshold, as when a person is sitting in the chair, the pressure sensitive switch is on, and air supply 30 is operational.

Use

The apparatus is preferably portable and easily assembled in conjunction with conventional chairs. The power supply switch and controls for durations of the intervals of the cycle and for delivery pressure preferably are readily accessible to the user and easy to understand and manipulate. The apparatus preferably meets all hospital structural and electrical safety standards.

The invention can be used by a person on the advice and with the consultation of a physician or a specialist in dealing with the prevention of and therapies for back pain. The consultant can suggest on the basis of his or her evaluation which range of spinal mobilization and durations of cycle intervals would be most beneficial to the person. Alternatively, a person can simply set the controls 39 to provide his or her own personal optimum of lumbar movement.

Now, with reference to FIGs. 3, 3*a* and again to FIG. 1, FIGS. 3, 3*a* show, in diagrammatic side view, the torso and part of a leg of a person 50 sitting normally in a chair provided as in FIG. 1 with an air bag 20 of the invention. Air bag 20 is affixed to the chair so that it rests upon forward surface 16 of chair back 14 and is positioned behind and adjacent a person sitting normally in the chair, to provide a cushion of a cyclically varying thickness between chair back 14 and the lumbar region 54 of the person, shown in part at 50 in FIGS. 3, 3*a*. Air bag 20 is oriented with its length dimension L generally horizontal and generally parallel to the forward surface of chair back 14, and with its width dimension W generally vertical. Air bag 20 can be removably affixed to chair back 14 by elastic strap 26 attached to bag 20 and passing around the back of the chair, as shown in FIG. 1.

As shown diagrammatically in FIG. 4, a control knob 39*a* is operationally connected to variable pressure release valve 33 to permit the user to set the input flow rate. Variable pressure release valves that are adjustable in this fashion are well-known in the pneumatics or hydraulics art. Timer 19 is provided with control knobs 39*b*, 39*c* by which the duration of the inflation interval and the duration of the deflation interval can be set by the user. The solenoids of 3-way solenoid valves 21, 18 are electrically linked to timer 19 so that timer 19 activates the valves 21, 18 to direct the flow cyclically through the timed inflations and deflations as described generally above with reference to FIGS. 4*a*, 4*b*.

During an inflation interval, as air bag 20 expands as it is inflated, the thickness T, that is, the short dimension of cross-section C, increases, and as air bag rear surface 25 presses against forward surface 16 of chair back 14 and air bag front surface 24 presses against lumbar region 54 of the person 50 sitting in the chair, lumbar region 54 of the person 50 is pressed forward, extending the person's spine, the outline of which is shown generally by broken line 52, to positions of progressively greater lordosis. As the person s lumbar region 54 continues to be pressed forward, the person's spine 52 increasingly resists further extending, until a point is reached where the pressure of resistance, together with other external pressures, equals the air pressure within air bag 20. At this point air bag 20 ceases to expand and its thickness reaches a maximum T″, and extending of the spine 52 ceases; this is the point of maximum lordosis, shown in FIG. 3.

At the completion of the inflation interval, the timer causes the solenoid valves to switch from their inflation interval positions to their deflation interval positions, as described above with reference to FIGs. 4, 4*a*, 4*b*, and air is permitted to flow out from air bag 20 through port 23 via conduit 22. Air bag 20 collapses between chair back forward surface 16 and lumbar region 54 of the person 50 as the person's spine 52 returns to a position of lesser lordosis, as shown in FIG. 3*a*.

Depending upon the rates of flow, inflation of the bag can be complete within a period of time less deflation of the bag can be complete within a period of time less than the duration of the deflation interval. A variety of forms of cycles can thus be provided by the preferred embodiment, as may be most appropriate for a variety of individual users needs. For example, by using comparatively high flow rates and comparatively long cycle intervals, a quick inflation can be followed by a pause for the remainder of the inflation interval, which can then be followed by a quick deflation and another pause for the remainder of the deflation interval. Preferably the durations of the inflation and the deflation intervals can be set independently of one another, so that, for example, a quick inflation during 10 a short inflation interval can be followed by a longer deflation interval before the next succeeding inflation.

Experience has shown that for persons having normal lumbar compliance, displacements in the order of at least about one inch and as much as three inches or more, delivered over a total cycle duration of twenty to thirty seconds (including both inflation and deflation intervals) generally can provide sufficient spinal mobilization to give a beneficial effect. Other displacements and cycle durations can be appropriate for other users, and the pressure limit and the intervals can be easily set according to the invention. Generally a total cycle duration that is too short (in the order, for example, of about five seconds or less) does not permit the spine to respond passively to effect a spinal mobilization, and can be distracting to the user, while a total cycle duration that is too long (in the order, for example, of ten minutes) can result in static conditions between successive inflations and deflations, reducing the effectiveness of the spinal movements.

Other Embodiments

Other embodiments are within the following claims. For example, the bag can be inflated with a fluid other than air, such as, for example, water. In such an embodiment the apparatus can be adapted as a closed system; that is, fluid is drawn by a fluid pump from a reservoir, then supplied through the regulator to and from the bag, and then returned to the reservoir. Where a liquid fluid is used, the apparatus preferably further includes a heater for heating the fluid so that the bag is not uncomfortably cold to the user. Such a heater may be installed in conjunction with, or as a part of, the reservoir.

The bag can be constructed from an elastomeric material such as rubber as a seamless bladder by methods known in the polymer art. The material can be capable of stretching when the bag is inflated, but preferably it is sufficiently resistant to stretching that inflation results in an increase in the thickness of the bag sufficient to provide the required lordotic movement, while other dimensions of the bag are sufficiently stable to provide the necessary support without excessive bulging. Such a bag may increase to a small extent in length and in width (L, W, in FIGS. 2, 2*a*) as it increases in thickness (T, in FIGS. 2, 2*a*) as required during inflation.

The bag can be affixed to the chair back by any of known attachment means, and the elastic means shown in the preferred embodiment is by way of example only. The fluid-inflatable bag of the apparatus can be attached to a conventional chair, either removably, as in the preferred embodiment, or more permanently. A chair can also be adapted to have a fluid-inflatable bag of the apparatus as an integral part thereof. For example, the bag can be lodged within the chair back and the chair back and bag can be covered, as desired, with an upholstery material, including, for example, a layer of foam or fabric, that substantially conceals the bag yet does not interfere with prescribed ranges of expansion and collapse of the bag.

The pressure sensing device is a feature for convenience, and can be omitted entirely, so that the user switches the air supply on or off manually. Where the pressure sensing device is used, the chair seat can be adapted to have the inflatable bladder as an integral part thereof.

Certain commercially available fluid pumps and cycling flow and pressure-regulating apparatus can be used to provide a source of fluid under pressure in place of the source of fluid provided by pump 17 and to provide a regulator in place of the regulator provided by timer 19, timer-operated valves 18, 21, valve 33 and valve 40, such as, for example, certain of the Jobst Extremity Pumps, available from Jobst, Toledo, Ohio, which permit the user to set the degree of compression to be applied and to adjust the time intervals for compression and release.

The apparatus can be used in conjunction with any type of seat having a back; in particular, it can be used in conjunction with a motor vehicle seat. The apparatus can be used in conjunction with a horizontal surface upon which the user rests in a supine posture, as for example a bed or mattress.

I claim:

1. Apparatus for treating or preventing low back pain in a person, comprising a fluid-inflatable bag having a force-applying portion;

a source of air under pressure, a conduit adapted to conduct said fluid between said source and said bag, and a regulator adapted for automatically controlling flow of said fluid in said conduit, said flow of aid fluid cyclically causing inflation and deflation of said bag, said regulator thereby controlling the pressure of the fluid in said bag, said bag adapted to be positioned behind and adjacent the lumbar region of the person the force-applying portion of said bag not extending out of the lumbar region of the spine when the bag is so positioned, said inflation and deflation of said bag cyclically varying forces applied to the spine of the person thereby cyclically moving the spine through a substantial range of extents of lordosis.

2. The apparatus of claim 1 wherein said fluid comprises air.

3. The apparatus of claim 2 wherein said source of said fluid under pressure comprises an air pump.

4. The apparatus of claim 2, further comprising a valve adapted for adjustably limiting the pressure of said fluid in said bag.

5. The apparatus of claim 1 wherein said fluid flow in a direction causing inflation of said bag occurs during an inflation interval, and said regulator is adapted to control the duration of said inflation interval.

6. The apparatus of claim 1 wherein said fluid flow in a direction causing inflation of said bag occurs during an inflation interval, said fluid flow in a direction causing deflation of said bag occurs during an deflation interval, and said regulator is adapted to control the durations of said intervals of inflation and deflation, and the sum of the said durations is at least five seconds and less than ten minutes.

7. The apparatus of claim 1 wherein said regulator includes a timer for controlling the duration of said inflation interval.

8. The apparatus of claim 1 wherein said regulator includes a timer for controlling the duration of said deflation interval.

9. The apparatus of claim 1, further comprising a valve adapted for adjustably limiting the rate of said fluid flow in said conduit during said inflation.

10. A method for treating or preventing low back pain in a person, comprising providing a fluid-inflatable bag having a force-applying portion, positioning said bag behind and adjacent the lumbar region of the person the force-applying portion of said bag not extending out of the lumbar region of the spine when so positioned, and cyclically directing fluid to flow into said bag to inflate said bag and allowing fluid to flow out from said bag to deflate said bag to vary forces applied to the spine of the person thereby cyclically moving the spine through a substantial range of extents of lordosis.

11. The method of claim 10, whereby said flow of fluid into said bag occurs during an inflation interval and said flow of fluid out of said bag occurs during a deflation interval, the method further comprising controlling the duration of said inflation interval.

12. The method of claim 10 wherein said flow of fluid into said bag occurs during an inflation interval and said flow of fluid out of said bag occurs during a deflation interval, the method further comprising controlling the durations of said inflation and deflation intervals, such that the sum of the said durations is at least five seconds and less than ten minutes.

13. The method of claim 10, said method further comprising adjustably limiting the pressure of said fluid in said bag.

14. The method of claim 10, said method further including adjustably limiting the rate of said flow of fluid into said bag.

15. The method of claim 10, said method further including adjustably limiting the rate of said flow of fluid out of said bag.

16. The apparatus of claim 1 adapted for use in conjunction with a seat having a back, said fluid-inflatable bag being affixed to said back of said seat.

17. The apparatus of claim 1 adapted for use in conjunction with a seat having a back, said fluid-inflatable bag being removably affixed to said back of said seat.

18. The apparatus of claim 1 wherein said fluid-inflatable bag is constructed as an integral part of a back portion of a seat.

* * * * *

UNITED STATES PATENT AND TRADEMARK OFFICE

CERTIFICATE OF CORRECTION

PATENT NO. : 4,981,131

DATED : January 1, 1991

INVENTOR(S) : Rowland G. Hazard

It is certified that error appears in the above-identified patent and that said Letters Patent is hereby corrected as shown below:

Column 2, line 13: change "soft tissue" to --soft-tissue--.
line 43: change "-the" to --the--.

Column 3, line 3: change "fluid inflatable" to --fluid-inflatable--.
line 40: change "and-spinal" to --and spinal--.
line 46: change "is" to --is,--.
line 54: change "fluid inflatable" to --fluid-inflatable--.

Column 6, line 42: change "pressure sensitive" to --pressure-sensitive--.

Column 7, line 59-61: change "deflation of the bag can be complete within a period of time less than the duration of the deflation interval." to --than the duration of the inflation interval, and deflation of the bag can be complete within a period of time less than the duration of the deflation interval.--

Column 8, line 4: delete "10".

Column 9, line 28: change "aid" to --said--.

Signed and Sealed this

Nineteenth Day of May, 1992

*Attest:*

DOUGLAS B. COMER

*Attesting Officer*

*Acting Commissioner of Patents and Trademarks*